US011404786B2

(12) United States Patent
Luk et al.

(10) Patent No.: US 11,404,786 B2
(45) Date of Patent: Aug. 2, 2022

(54) PLANAR COMPLEMENTARY ANTENNA AND RELATED ANTENNA ARRAY

(71) Applicant: City University of Hong Kong, Kowloon (HK)

(72) Inventors: Kwai Man Luk, Kowloon (HK); Jingtao Zeng, Foshan (CN)

(73) Assignee: City University of Hong Kong, Kowloon (HK)

( * ) Notice: Subject to any disclaimer, the term of this patent is extended or adjusted under 35 U.S.C. 154(b) by 188 days.

(21) Appl. No.: 16/502,131

(22) Filed: Jul. 3, 2019

(65) Prior Publication Data

US 2021/0005980 A1 Jan. 7, 2021

(51) Int. Cl.

| | |
|---|---|
| ***H01Q 21/06*** | (2006.01) |
| ***H01Q 5/40*** | (2015.01) |
| ***H01Q 1/38*** | (2006.01) |
| ***H01Q 7/00*** | (2006.01) |
| ***H01Q 9/28*** | (2006.01) |

(52) U.S. Cl.

CPC ..... *H01Q 5/40* (2015.01); *H01Q 1/38* (2013.01); *H01Q 7/00* (2013.01); *H01Q 9/285* (2013.01); *H01Q 21/062* (2013.01)

(58) Field of Classification Search

CPC ..... H01Q 9/065; H01Q 9/285; H01Q 21/062

See application file for complete search history.

(56) References Cited

U.S. PATENT DOCUMENTS

| | | | | |
|---|---|---|---|---|
| 6,593,886 | B2 * | 7/2003 | Schantz | H01Q 1/38 343/700 MS |
| 7,408,517 | B1 * | 8/2008 | Poilasne | H01Q 7/005 343/702 |
| 8,022,887 | B1 * | 9/2011 | Zarnaghi | H01Q 3/26 343/846 |
| 8,179,329 | B2 * | 5/2012 | Kato | G06K 19/07749 343/726 |
| 8,410,982 | B2 * | 4/2013 | Yung | H01Q 7/00 343/700 MS |
| 8,487,821 | B2 * | 7/2013 | Duron | H01Q 13/106 343/730 |
| 8,493,183 | B2 * | 7/2013 | Yamagajp | H01Q 1/38 343/866 |

(Continued)

OTHER PUBLICATIONS

K. M. Luk and H. Wong, "A new wideband unidirectional antenna element," Int. J. Microw. Opt. Technol., vol. 1, No. 1, pp. 35-44, Jun. 2006.

(Continued)

*Primary Examiner* — Ab Salam Alkassim, Jr.
(74) *Attorney, Agent, or Firm* — Renner Kenner Greive Bobak Taylor & Weber

(57) ABSTRACT

A planar complementary antenna and an antenna array with multiple planar complementary antennas. The planar complementary antenna has a substrate, a planar dipole antenna arranged on the substrate, a loop antenna arranged on the substrate and operably connected with the planar dipole antenna, and a feed network for connection with a feed source. The feed network is operably connected with the planar dipole antenna and the loop antenna for feeding an electrical signal from the feed source to the planar dipole antenna and the loop antenna so as to form an electric dipole at the planar dipole antenna and a magnetic dipole at the loop antenna.

22 Claims, 14 Drawing Sheets

(56) References Cited

U.S. PATENT DOCUMENTS 8,654,023 B2 * 2/2014 Brown ..... H01Q 1/48 343/748
9,954,288 B2 4/2018 Luk et al.
10,033,100 B1 * 7/2018 Chayat ..... H01Q 5/25
10,128,575 B2 * 11/2018 Ross, III ..... H01Q 1/36
10,387,763 B2 * 8/2019 Forster ..... G06K 19/07773
10,418,711 B2 * 9/2019 Geist ..... H01Q 9/285
11,276,934 B2 * 3/2022 Leung ..... H01Q 21/0068
2006/0055618 A1 * 3/2006 Poilasne ..... H01Q 7/00 343/866
2008/0024381 A1 * 1/2008 Vendik ..... H01Q 21/29 343/822
2009/0096676 A1 * 4/2009 Yan ..... H01Q 9/285 343/700 MS
2009/0096696 A1 * 4/2009 Joyce, Jr. ..... H01Q 9/24 343/793
2009/0121947 A1 * 5/2009 Nysen ..... H01Q 7/00 343/702
2009/0128440 A1 * 5/2009 Tavassoli Hozouri ... H01Q 9/27 343/821
2009/0160717 A1 * 6/2009 Tsutsumi ..... H01Q 19/30 343/726
2010/0103061 A1 * 4/2010 Yung ..... H01Q 21/29 343/730
2010/0283694 A1 * 11/2010 Kato ..... G06K 19/07786 343/730
2010/0308118 A1 * 12/2010 Kataya ..... H01Q 9/40 235/492
2010/0309068 A1 * 12/2010 Duron ..... H01Q 9/285 343/730
2012/0006904 A1 * 1/2012 Kato ..... G06K 19/07756 235/492
2013/0082893 A1 * 4/2013 Wang ..... H01Q 9/26 343/810
2013/0088304 A1 * 4/2013 Henderson ..... H01Q 1/273 333/33
2014/0125459 A1 * 5/2014 Sabahialshoara ..... H01Q 3/26 340/10.1
2014/0354509 A1 * 12/2014 Tayama ..... H01Q 7/00 343/867
2015/0288071 A1 * 10/2015 Toyao ..... H01Q 5/328 343/700 MS
2015/0349435 A1 * 12/2015 Xue ..... H01Q 21/29 343/726
2016/0013546 A1 * 1/2016 Toyao ..... H01Q 1/243 343/904
2017/0062939 A1 * 3/2017 Ross, III ..... H01Q 1/36
2017/0317422 A1 * 11/2017 Grando ..... H01P 5/10
2018/0019513 A1 * 1/2018 Farkas ..... H01Q 1/273
2018/0145409 A1 * 5/2018 Bringuier ..... H01Q 9/065
2018/0277957 A1 * 9/2018 Geist ..... H01Q 1/243
2019/0319369 A1 * 10/2019 Chiang ..... H01Q 7/00
2019/0363434 A1 * 11/2019 Ting ..... H01P 3/003
2020/0112088 A1 * 4/2020 Hamabe ..... H01Q 9/285
2020/0127375 A1 * 4/2020 Takai ..... H01Q 1/48
2020/0235466 A1 * 7/2020 Maccabe ..... H01P 5/028

OTHER PUBLICATIONS

H. Wong, K. M. Mak, and K. M. Luk, "Wideband shorted bowtie patch antenna with electric dipole," IEEE Trans. Antennas Propag., vol. 56, No. 7, pp. 2098-2101, Jul. 2008.
C. Tang and Q. Xue, "Vertical planar printed unidirectional antenna," IEEE Antennas Wireless Propag. Lett., vol. 12, pp. 368-371, 2013.
Y. Wang, M. Bialkowski, and A. Abbosh, "Double microstrip-slot transitions for broadband microstrip phase shifters," IEEE Microw. Wireless Compon. Lett., vol. 22, No. 2, pp. 58-60, Feb. 20.

* cited by examiner

PLANAR COMPLEMENTARY ANTENNA AND RELATED ANTENNA ARRAY

TECHNICAL FIELD

The invention relates to a planar complementary antenna and an antenna array formed with multiple such planar complementary antennas.

BACKGROUND

In the telecommunication industry, existing cellular antenna design tends to use a simple antenna, such as dipole antenna and invert-F antenna. However, these antennas have narrow bandwidth and low gain. With the emergence of 5G and other future wireless communication technologies, there is a need to provide antennas and hence communication devices that can provide improved performance.

SUMMARY OF THE INVENTION

In accordance with a first aspect of the invention, there is provided a planar complementary antenna having a substrate; a planar dipole antenna arranged on the substrate; a loop antenna arranged on the substrate and operably connected with the planar dipole antenna; and a feed network for connection with a feed source. The feed network is operably connected with the planar dipole antenna and the loop antenna for feeding an electrical signal from the feed source to the planar dipole antenna and the loop antenna so as to form an electric dipole at the planar dipole antenna and a magnetic dipole at the loop antenna. The planar dipole antenna, the loop antenna and/or the feed network may be formed by conductive strips (e.g., Copper strips). The loop antenna need not be in the form of a closed loop, but can be a loop-like antenna with opposite ends close to each other but spaced apart. The loop antenna is preferably a single-loop antenna. The planar complementary antenna may be formed from a PCB substrate.

In one embodiment of the first aspect, the planar dipole antenna and the loop antenna are both arranged on a first side of the substrate. Alternatively, the planar dipole antenna and the loop antenna are arranged on opposite sides of the substrate.

In one embodiment of the first aspect, the planar dipole antenna and the loop antenna are directly connected with each other or they are formed integrally.

In one embodiment of the first aspect, the planar dipole antenna has a first antenna portion and a second antenna portion that are symmetric about at least one symmetric axis.

In one embodiment of the first aspect, the first and second antenna portions each include: a first conductive strip portion and a second conductive strip portion generally extending at an angle to the first conductive strip portion. The first conductive strip portion is generally elongated but need not be straight. Likewise, the second conductive strip portion is generally elongated but need not be straight. Preferably, the angle is about 90 degrees. Alternatively, the angle may be between 45 degrees and 135 degrees.

In one embodiment of the first aspect, the feed network is arranged on a second side of the substrate, and the second side is opposite the first side.

In one embodiment of the first aspect, the planar complementary antenna further includes one or more vias extending through the substrate; the feed network is operably connected with the planar dipole and the loop antenna through the one or more vias.

In one embodiment of the first aspect, the feed network comprises a balun network.

In one embodiment of the first aspect, the balun network comprises a first conductive strip and a second conductive strip.

In one embodiment of the first aspect, the first conductive strip provides an input portion for connection with the feed source.

In one embodiment of the first aspect, the second conductive strip provides a phase inverter.

In one embodiment of the first aspect, the first conductive strip and the second conductive strip are arranged on a second side of the substrate, wherein the second side is opposite the first side.

In one embodiment of the first aspect, the first conductive strip and the second conductive strip are spaced apart and extending substantially in parallel.

In one embodiment of the first aspect, the first conductive strip is arranged on a second side of the substrate and the second conductive strip is arranged on the first side of the substrate; wherein the second side is opposite the first side.

In one embodiment of the first aspect, the second conductive strip is connected directly across the loop antenna.

In one embodiment of the first aspect, the feed network comprises a differential feed network.

In one embodiment of the first aspect, the differential feed network is arranged on a second side of the substrate, wherein the second side is opposite the first side.

In one embodiment of the first aspect, the differential feed network comprises two input portions each arranged to receive a respective input signal, the two input signals being out of phase.

In one embodiment of the first aspect, the planar complementary antenna further includes a ground plane arranged on the first side of the substrate.

In one embodiment of the first aspect, the ground plane is at least partly integral with the loop antenna.

In one embodiment of the first aspect, the ground plane is spaced apart from the loop antenna.

In one embodiment of the first aspect, the planar complementary antenna is arranged for operation at GHz and THz frequencies.

In accordance with a second aspect of the invention, there is provided an antenna array having a substrate and a plurality of antenna units. Each of the antenna units includes a planar dipole antenna arranged on the substrate; a loop antenna arranged on the substrate and operably connected with the planar dipole antenna; and a feed network for connection with a feed source. The feed network is operably connected with the planar dipole antenna and the loop antenna for feeding an electrical signal from the feed source to the planar dipole antenna and the loop antenna so as to form an electric dipole at the planar dipole antenna and a magnetic dipole at the loop antenna. The planar dipole antenna, the loop antenna and/or the feed network may be formed by conductive strips (e.g., Copper strips). The loop antenna need not be in the form of a closed loop, but can be a loop-like antenna with opposite ends close to each other but spaced apart. The loop antenna is preferably a single-loop antenna. The antenna array may be formed from a PCB substrate.

In one embodiment of the second aspect, each of the antenna units includes a planar complementary antenna of the first aspect.

In one embodiment of the second aspect, the antenna array is arranged for operation at GHz and THz frequencies.

In accordance with a third aspect of the invention, there is provided a communication device including the planar complementary antenna of the first aspect. The communication device may be a mobile communication device.

In accordance with a fourth aspect of the invention, there is provided communication device the antenna array of the second aspect. The communication device may be a mobile communication device.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1A:
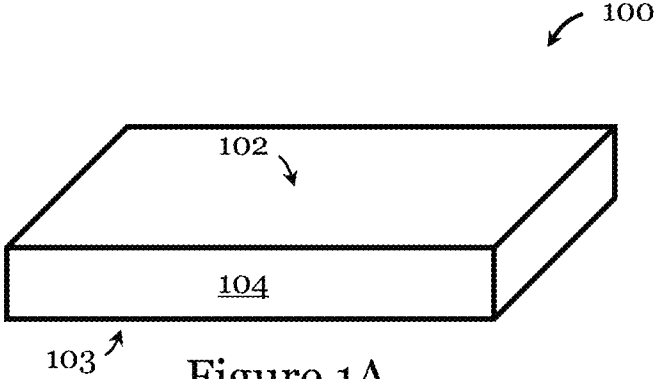
FIG. 1A is a schematic diagram of a planar complementary antenna in one embodiment of the invention.
Figure 1B:
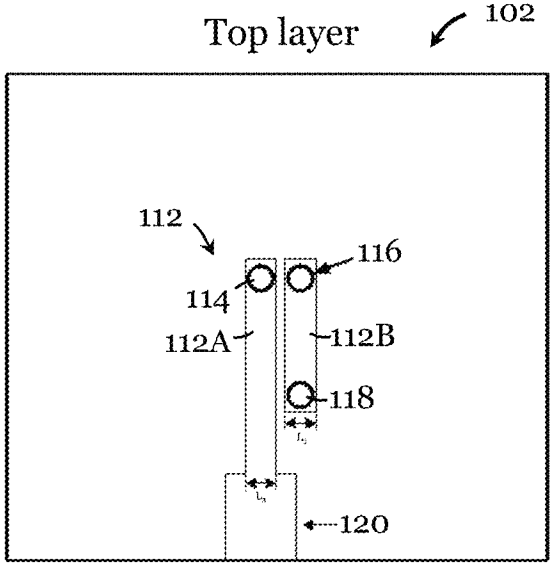
FIG. 1B is a plan view of a bottom layer of the planar complementary antenna of FIG. 1A in one embodiment of the invention.
Figure 1C:
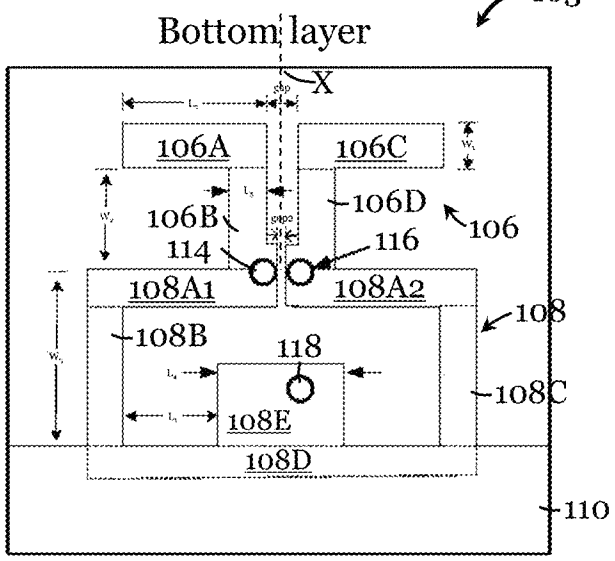
FIG. 1C is a plan view of a top layer of the planar complementary antenna of FIG. 1A in one embodiment of the invention.

FIGS. 1A to 1C illustrate a planar complementary wideband antenna 100 in one embodiment of the invention. As shown in FIG. 1A, the antenna 100 includes a substrate 104 and top and bottom layers 102, 103 (FIGS. 1B and 1C respectively) formed on opposite sides of the substrate 104. In this embodiment, the substrate 104 is made from Duroid® 5880 of Rogers Corporation, with a thickness of 0.254 mm.

The antenna 100 includes a planar dipole antenna 106 and a loop antenna 108 that are operably connected with each other, and a feed network 112 for connection with a feed source. The feed network 112 is operably connected with the planar dipole antenna 106 and the loop antenna 108 for feeding an electrical signal from the feed source to the planar dipole antenna 106 and the loop antenna 108 so as to form an electric dipole at the planar dipole antenna 106 and a magnetic dipole at the loop antenna 108.

As shown in FIG. 1C, the planar dipole antenna 106 and the loop antenna 108 are both arranged on the same (bottom 103) side of the substrate 104. The planar dipole antenna 106 and the loop antenna 108 are directly connected with each other, i.e., formed integrally.

The planar dipole antenna 106 has a first portion and a second portion that are symmetric about an axis X. The first and second portions each includes a first elongated conductive strip portion 106A, 106C and a second elongated conductive strip portion 106B, 106D generally extending at an angle to the respective first conductive strip portion 106A, 106C. In this embodiment, the first and second elongated conductive strip portions 106A-106D are generally rectangular (or straight), and the angle between them is about 90 degrees.

The loop antenna 108 includes a loop-like portion with opposite ends that are close but spaced apart. The loop-like portion includes two generally parallel long sides and two generally parallel short sides. The short sides are generally perpendicular to the long sides. One of the long sides is formed by two elongated conductive strip portions 108A1, 108A2 each connected with a respective half of the planar dipole antenna 106. The elongated conductive strip portions 108A1, 108A2 are generally rectangular (or straight), each being generally perpendicular to the respective second elongated conductive strip portion 106B, 106D. The other long side is formed by an elongated conductive strip portion 108D that is generally rectangular. The short sides are formed by elongated conductive strip portions 108B, 108C that connect the two long sides at respective ends. The elongated conductive strip portions 108B, 108C are generally rectangular. A generally rectangular conductive patch portion 108E is continuous with the elongated conductive strip portion 108D and is arranged within a space defined by the long sides and the short sides. The elongated conductive strip portion 108D is arranged to connect the two short elongated conductive strip portions 108B, 108C such that they are electrically-shorted. The generally rectangular conductive patch portion 108E is arranged to form the ground of the feed network on the opposite (top) side 102 on the substrate 104.

As shown in FIG. 1C, a ground plane 110 for microstrip line feeding is formed on the bottom side 103 of the antenna 100. In this example, the ground plane 110 is integrally formed with the elongated conductive strip portion 108D and the conductive patch portion 108E.

Referring now to FIG. 1B, a feed network 112 is formed on the top layer 102. In this example, the feed network 112 is a balun network (balanced to unbalanced feeding network) that transmits an electric signal to the planar dipole antenna 106 and the loop antenna 108. The balun network includes a first conductive strip 112A that provides an input portion for connection with the feed source, and a second conductive strip 112B that provides a phase inverter. As shown in FIG. 1B, the first and second conductive strips 112A, 112B are spaced apart and extending substantially in parallel. The first conductive strip 112A is connected at one end with a microstrip line 120 (50-Ohm in this example), which can be fed by another microstrip line, SMA connector, or other feed sources. The first conductive strip 112A is connected with a via 114 that extends through the substrate 104 to connect with the planar dipole antenna 106 and the loop antenna 108. The second conductive strip 112B is connected with vias 116, 118 at opposite ends. The via 116 connects with the planar dipole antenna 106 and the loop antenna 108; the via 118 connects with the generally rectangular conductive patch portion 108E. The feed network 112 can provide a stable phase shift within a wide operating frequency.

In operation, the signal from the feed source is transmitted to the portions 106B, 108A1 through the input portion 112A. Also, part of the signal would couple to a slot formed between portions 108A1 and 108E. The signal in the slot would be coupled to the second conductive strip 112B. The signal flow direction in the second conductive strip 112B is opposite to signal flow direction in the first conductive strip 112A so the signals have a 180 degrees phase difference. Then, the signal will be transmitted to portions 106D and 108A2. The input resistance of the antenna 100 can be controlled by varying the width $L_3$ of strip 112A.

The Table below shows exemplary dimensions (in mm and as wavelength fractions) for the antenna structures of FIGS. 1B and 1C for an operating center frequency of 30 GHz.

| Parameters | $L_1$ | $L_2$ | $L_3$ | $L_4$ | $L_5$ |
|---|---|---|---|---|---|
| Values(mm) | 1.5<br>0.15λ | 2.3<br>0.23λ | 0.57<br>0.06λ | 2<br>0.2λ | 0.6<br>0.06λ |
| Parameters | $W_1$ | $W_2$ | $W_3$ | gap | gap2 |
| Values(mm) | 0.7<br>0.07λ | 1.6<br>0.16λ | 2.8<br>0.28λ | 0.5<br>0.05λ | 0.12<br>0.01λ |

Figure 2:
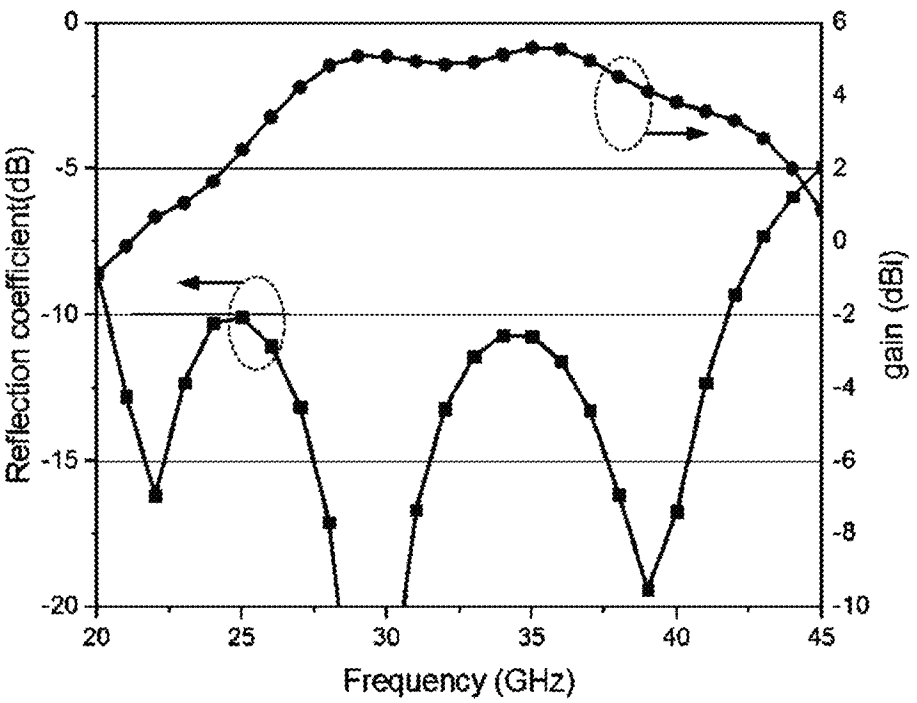
FIG. 2 is a plot showing the simulated reflection coefficient and gain with respect to frequency for the planar complementary antenna of FIGS. 1A-1C.

FIG. 2 show the simulated reflection coefficient and simulated gain as a function of frequency for the antenna of FIGS. 1A to 1C. As shown in FIG. 2, the antenna 100 has a wide impedance bandwidth of 69%, with S11<−10 dB from 20.3 GHz to 41.7 GHz, and a peak gain of 5.3 dBi.

Figure 3A:
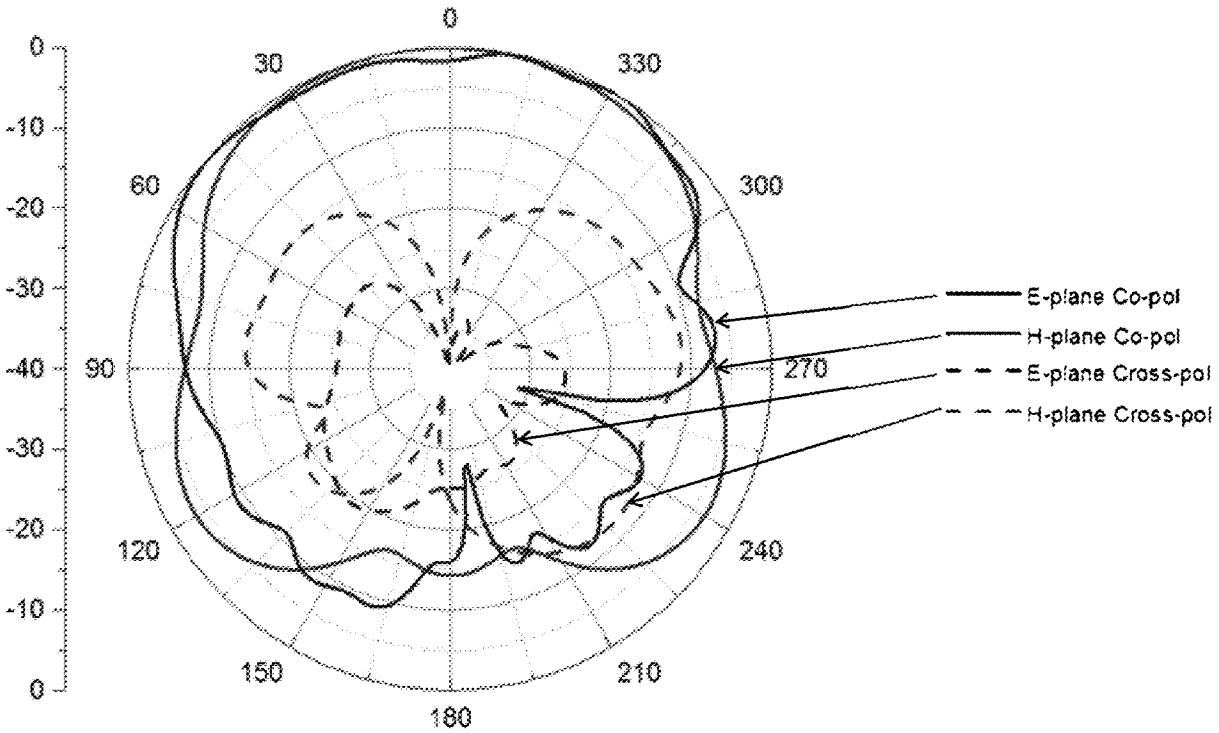
FIG. 3A is a plot showing the simulated radiation pattern for the planar complementary antenna of FIGS. 1A-1C at 23 GHz.
Figure 3B:
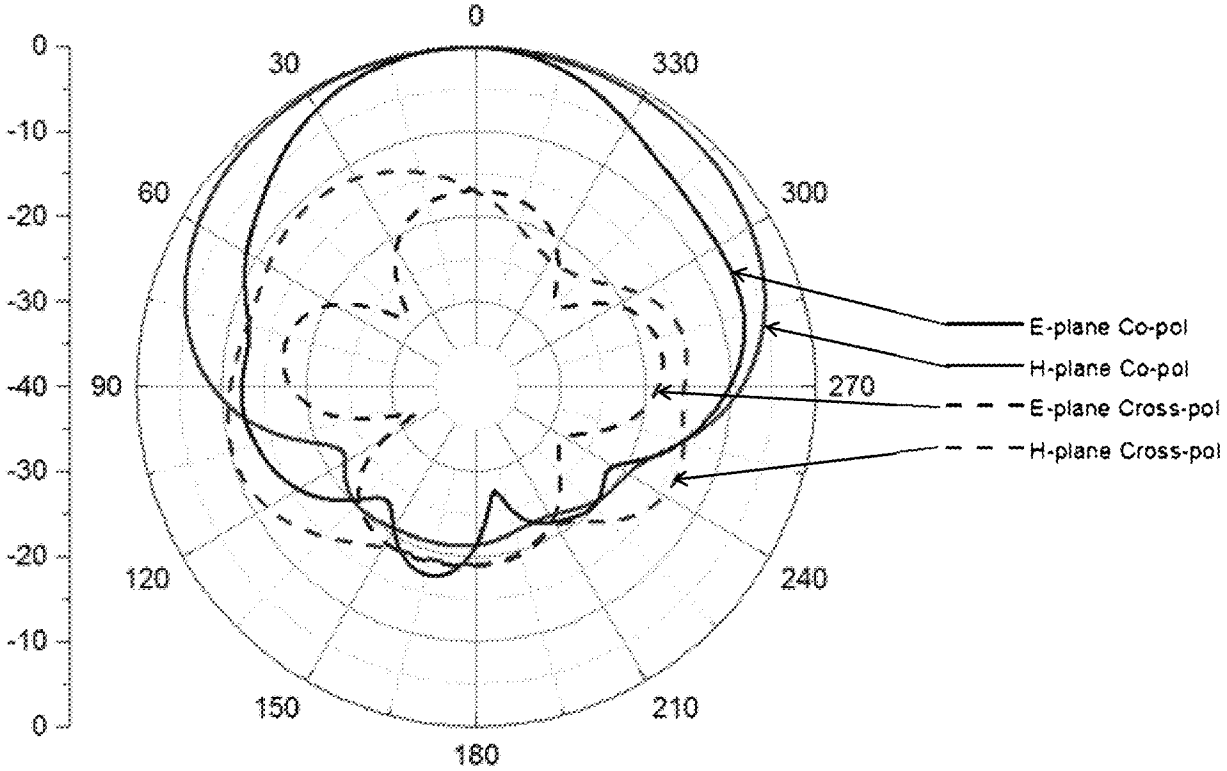
FIG. 3B is a plot showing the simulated radiation pattern for the planar complementary antenna of FIGS. 1A-1C at 30 GHz.
Figure 3C:
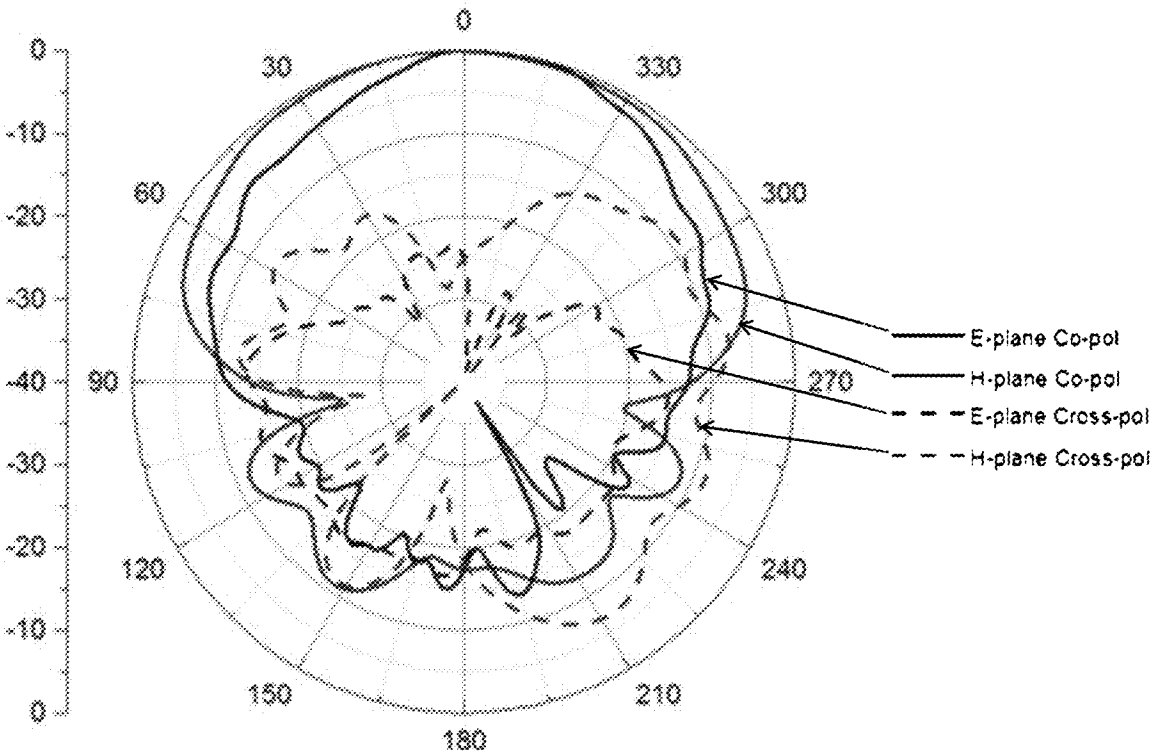
FIG. 3C is a plot showing the simulated radiation pattern for the planar complementary antenna of FIGS. 1A-1C at 40 GHz.

FIGS. 3A to 3C show simulated radiation patterns for the antenna 100 of FIGS. 1A to 1C at 23 GHz, 30 GHz and 40 GHz respectively. As shown in these Figures, in both E and H planes, the end-fire radiation patterns are stable. Also, low back radiation is observed across the entire operating bandwidth.

Figure 4B:
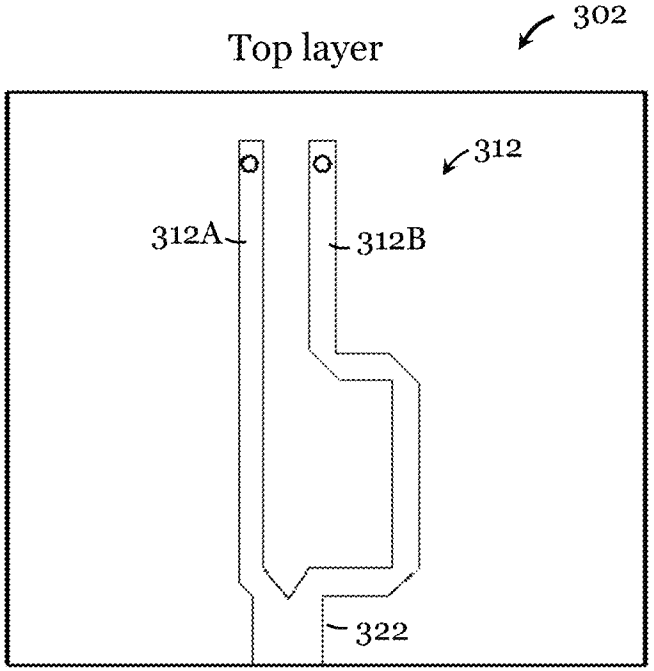
FIG. 4B is a plan view of a top layer of a planar complementary antenna in one embodiment of the invention.
Figure 4A:
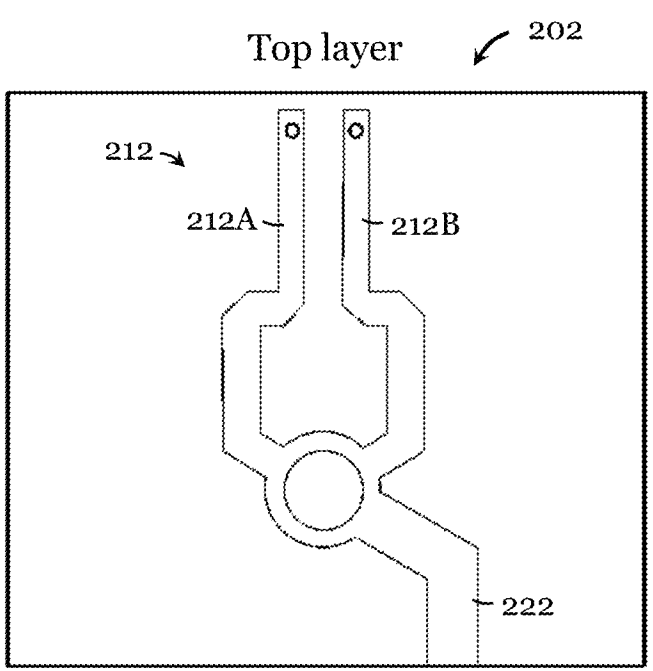
FIG. 4A is a plan view of a top layer of a planar complementary antenna in one embodiment of the invention.

FIGS. 4A and 4B show alternative embodiments of the feed network 212, 312 of the top layer 202, 302. In the embodiment of FIG. 4A, the feed network 212 includes first and second conductive strips 212A, 212B (generally elongated, not straight) operably connected with each other via a common portion 222. Each strip 212A, 212B is connected with a respective via at the terminal end (the bottom layer has corresponding via locations). In the embodiment of FIG. 4B, the feed network 312 includes first and second conductive strips 312A, 312B (generally elongated, not straight) operably connected with each other via a common portion 322. Each of the strips 212A, 212B is connected with a respective via near its open end (the bottom layer has corresponding via locations).

Figure 5B:
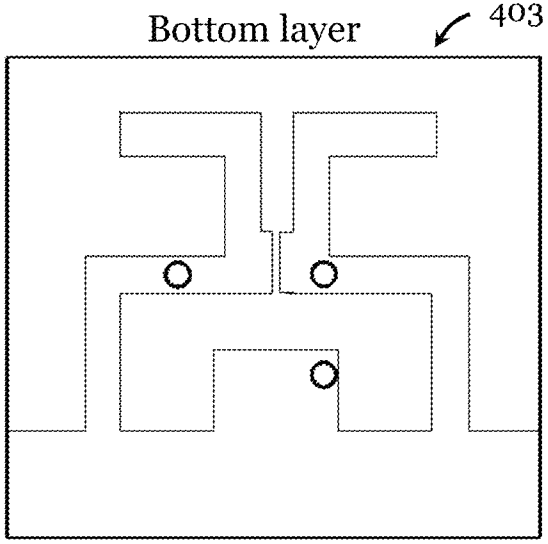
FIG. 5B is a plan view of a bottom layer of a planar complementary antenna in one embodiment of the invention.
Figure 5A:
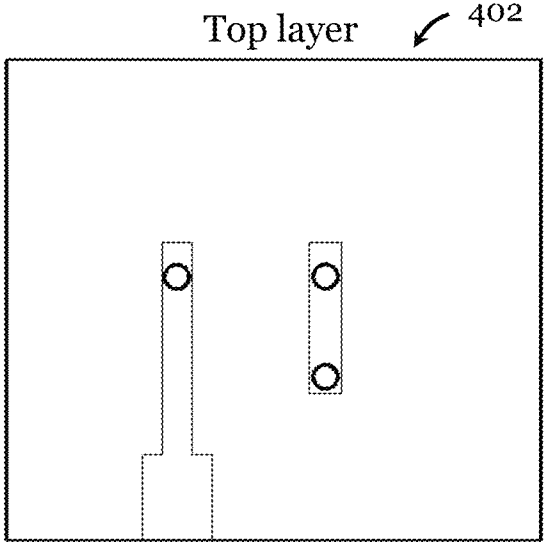
FIG. 5A is a plan view of a top layer of a planar complementary antenna in one embodiment of the invention.

FIGS. 5A and 5B show an alternative embodiment of the top and bottom layers 402, 403 of the antenna. The main difference between this embodiment and the embodiment of FIGS. 1B and 1C is that the locations of the vias are changed.

Figure 6B:
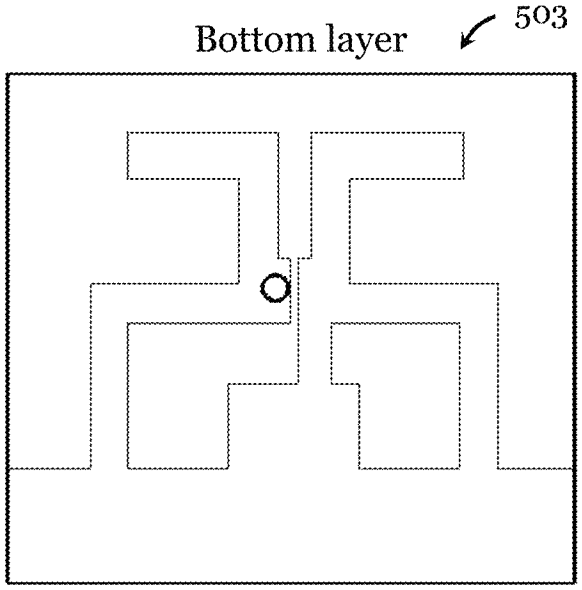
FIG. 6B is a plan view of a bottom layer of a planar complementary antenna in one embodiment of the invention.
Figure 6A:
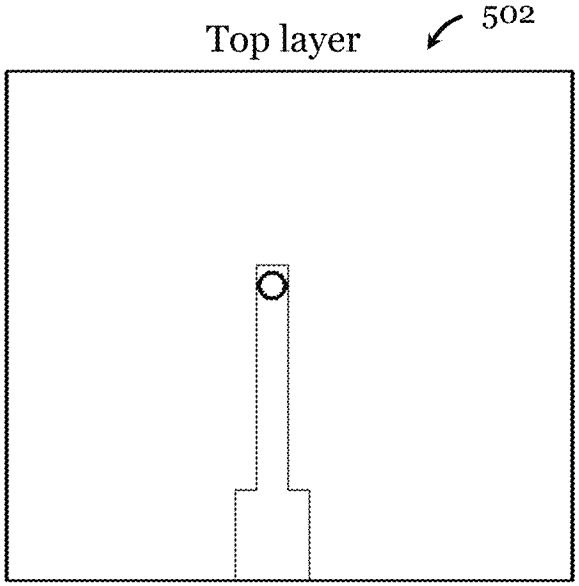
FIG. 6A is a plan view of a top layer of a planar complementary antenna in one embodiment of the invention.

FIGS. 6A and 6B show an alternative embodiment of the top and bottom layers 502, 503 of the antenna. The main differences between this embodiment and the embodiment of FIGS. 1B and 1C are that: (1) the second conductive strip 112B of the feed network 112 on the top side has been moved to the bottom side, as a conductive strip connected directly across the loop antenna, and (2) the vias associated with the second conductive strip 112B are no longer present.

Figure 7B:
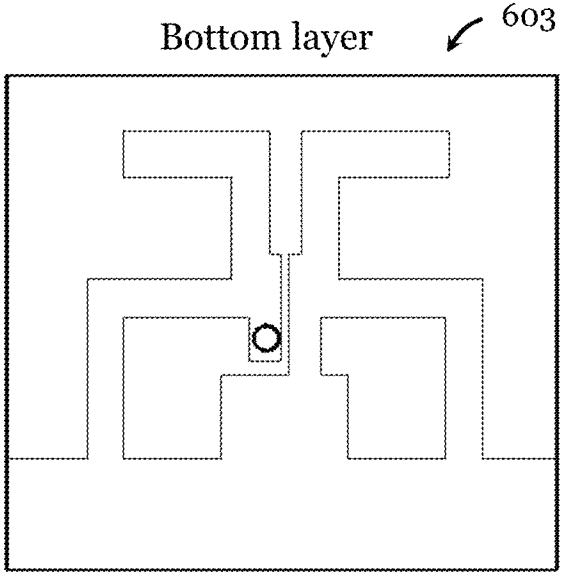
FIG. 7B is a plan view of a bottom layer of a planar complementary antenna in one embodiment of the invention.
Figure 7A:
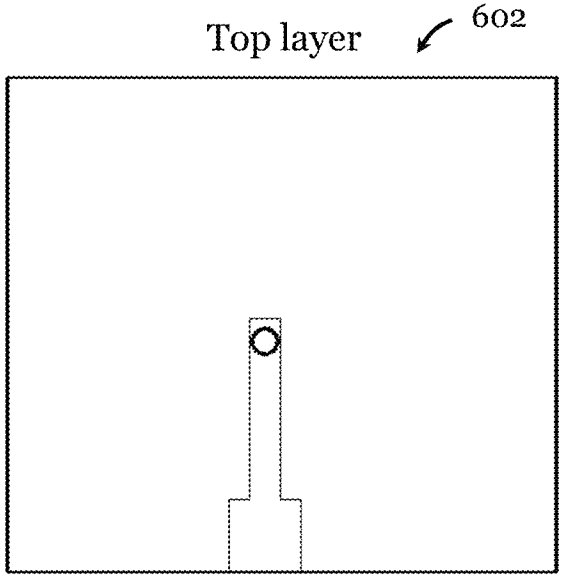
FIG. 7A is a plan view of a top layer of a planar complementary antenna in one embodiment of the invention.

FIGS. 7A and 7B show an alternative embodiment of the top and bottom layers 602, 603 of the antenna. The main difference between this embodiment and the embodiment of FIGS. 6B and 6C are that the feeding point of the antenna (the location of the via) has changed.

Figure 8B:
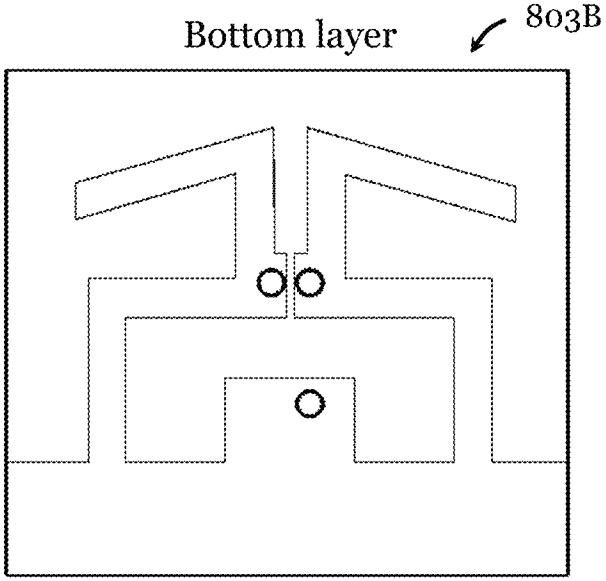
FIG. 8B is a plan view of a bottom layer of a planar complementary antenna in one embodiment of the invention.
Figure 8A:
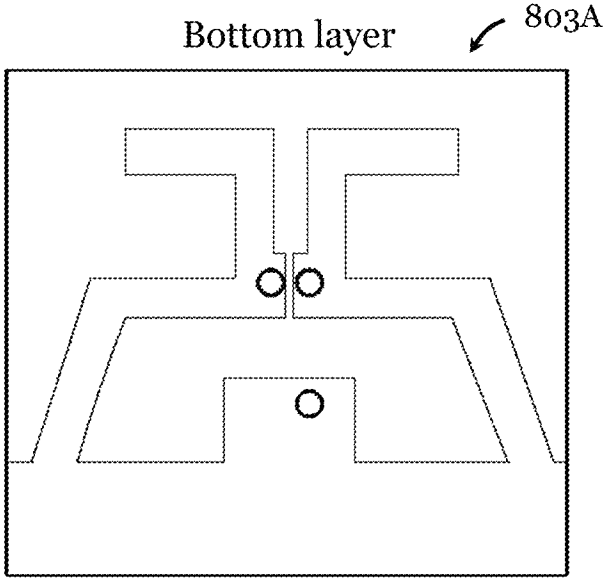
FIG. 8A is a plan view of a bottom layer of a planar complementary antenna in one embodiment of the invention.
Figure 8D:
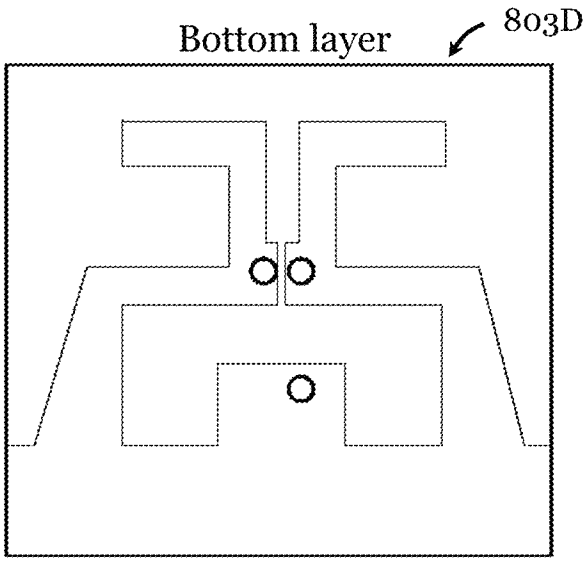
FIG. 8D is a plan view of a bottom layer of a planar complementary antenna in one embodiment of the invention.
Figure 8C:
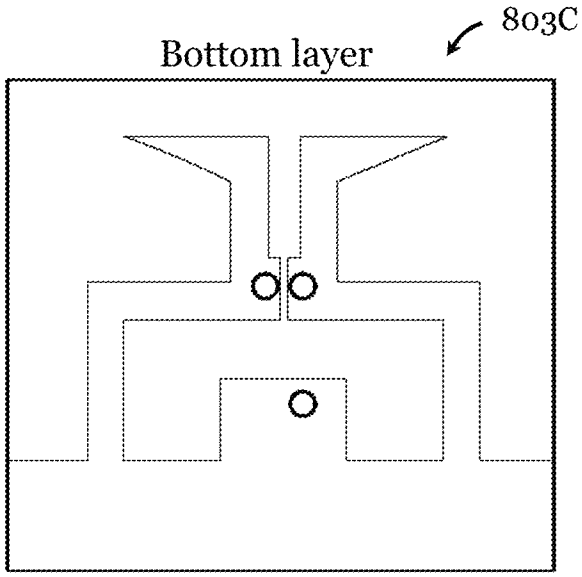
FIG. 8C is a plan view of a bottom layer of a planar complementary antenna in one embodiment of the invention.

FIGS. 8A to 8D show different embodiments of the bottom layers 803A-803D of the antenna. In FIG. 8A, as compared with the embodiment of FIG. 1C, the elongated conductive strip portions 108B, 108C are no longer perpendicular to the long sides, but at an angle of less than 90 degrees to the long sides. In FIG. 8B, as compared with the embodiment of FIG. 1C, the elongated conductive strip portions 106A, 106C are no longer perpendicular to the strip portions 106B, 106D, but at an angle of less than 90 degrees to the strip portions 106B, 106D. In FIG. 8C, as compared with the embodiment of FIG. 1C, the elongated conductive strip portions 106A, 106C are no longer rectangular but triangular. In FIG. 8D, as compared with the embodiment of FIG. 1C, the elongated conductive strip portions 108B, 108C are no longer perpendicular to the long sides, but at an angle of less than 90 degrees to the long sides. Also, the elongated conductive strip portions 108B, 108C taper from one long side to the other long side.

Figure 9:
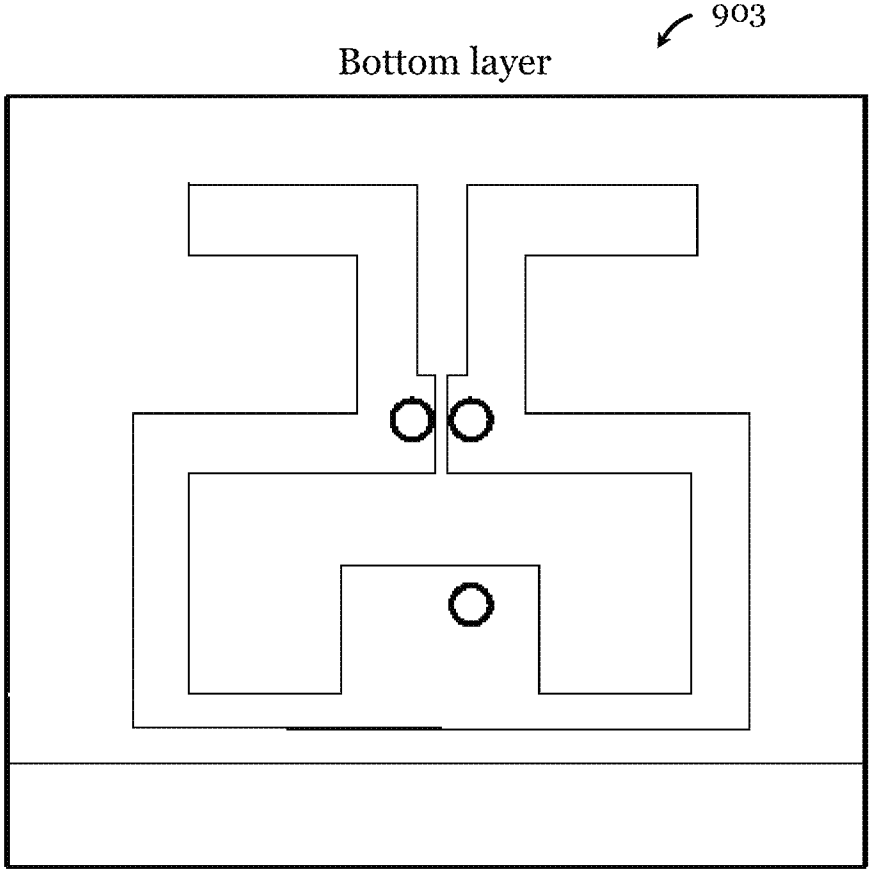
FIG. 9 is a plan view of a bottom layer of a planar complementary antenna in one embodiment of the invention.

FIG. 9 shows an alternative embodiment of the bottom layer 903 of the antenna. The main difference between this embodiment and the embodiment of FIG. 1C is that the ground plane is now spaced apart from the loop antenna.

Figure 10A:
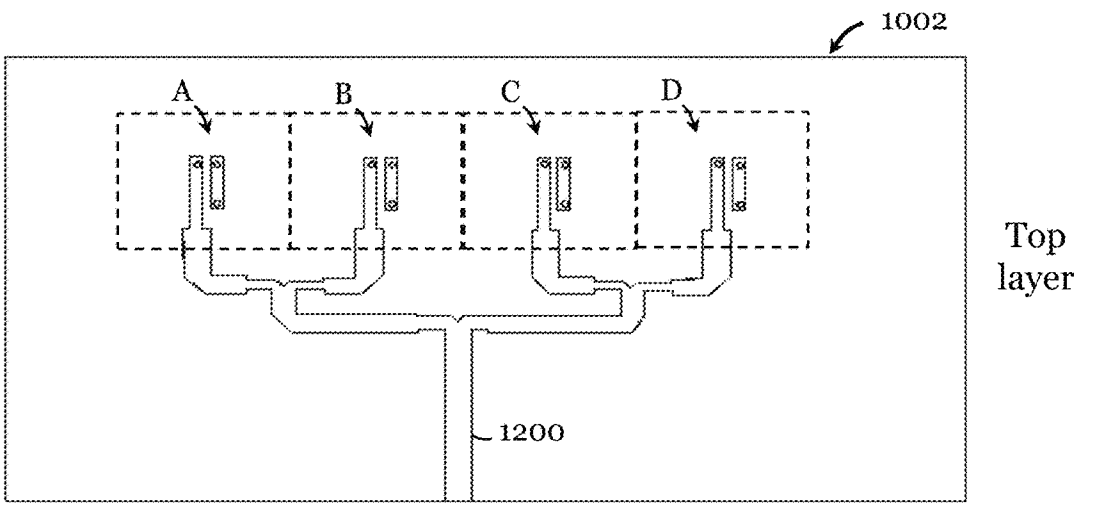
FIG. 10A is a plan view of a top layer of a planar complementary antenna (in the form of a 1×4 antenna array) in one embodiment of the invention.
Figure 10B:
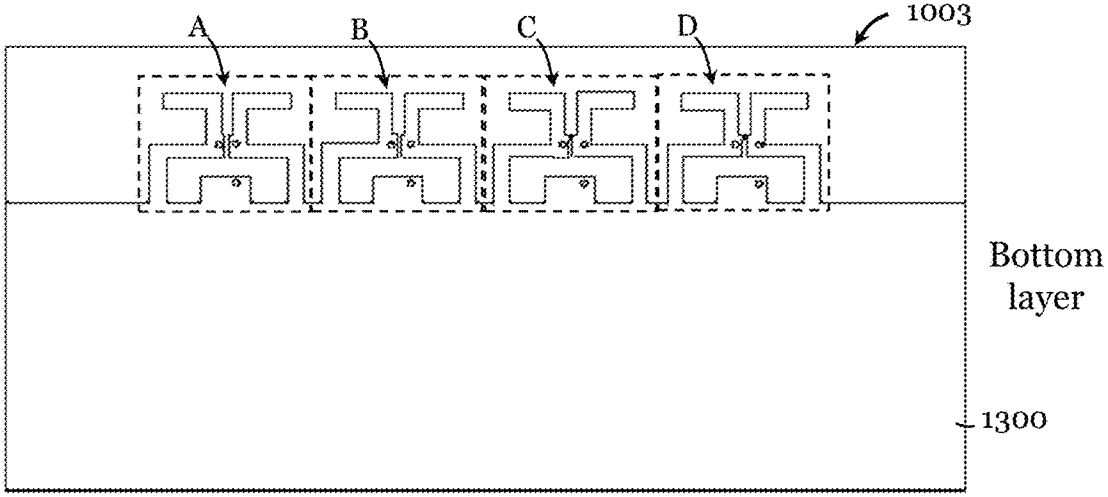
FIG. 10B is a plan view of a bottom layer of a planar complementary antenna (in the form of a 1×4 antenna array) in one embodiment of the invention.

FIGS. 10A and 10B show the top and bottom layers 1002, 1003 of a planar complementary wideband antenna array having multiple complementary wideband antennas in one embodiment of the invention. For simplicity the substrate is not shown. As shown in FIGS. 10A and 10B, the antenna array include multiple planar complementary wideband antennas of like construction as that of FIGS. 1A to 1C. These planar complementary wideband antennas are connected to a common input 1200, and to a common ground plane 1300. In this embodiment, the antennas too are arranged in a 1×4 array structure.

Figure 11B:
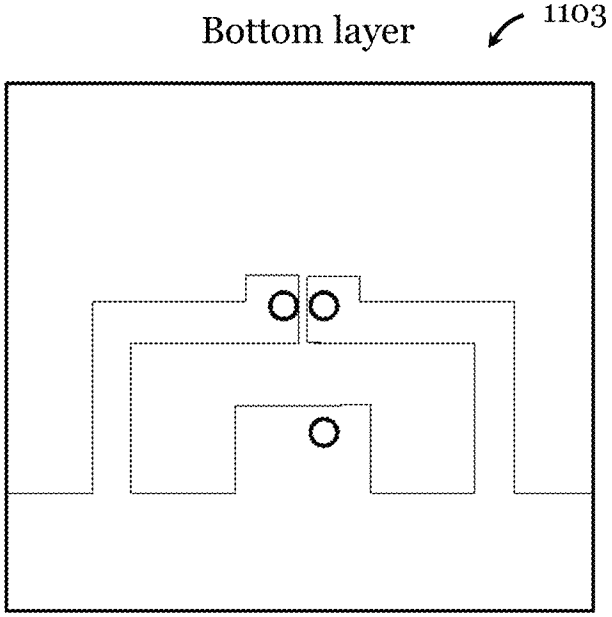
FIG. 11B is a plan view of a top layer of a planar complementary antenna of FIG. 1A in one embodiment of the invention
Figure 11A:
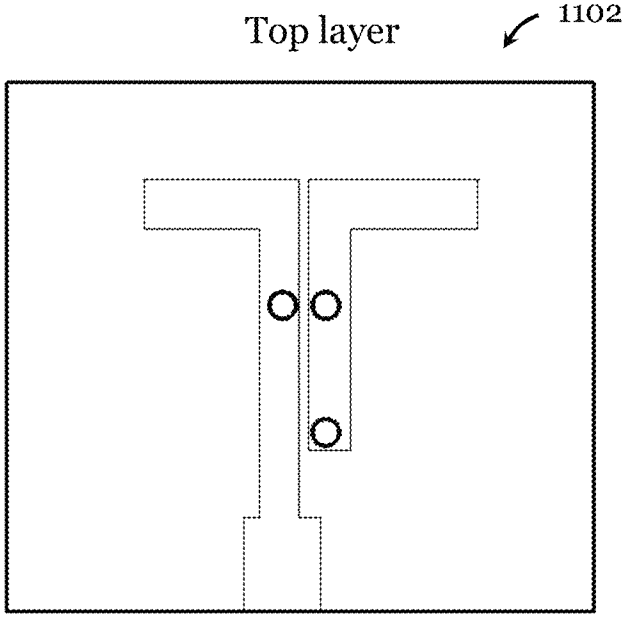
FIG. 11A is a plan view of a bottom layer of a planar complementary antenna of FIG. 1A in one embodiment of the invention.

FIGS. 11A and 11B show an alternative embodiment of the top and bottom layers 1102, 1103 of the antenna. The main difference between this embodiment and the embodiment of FIGS. 1B and 1C is that in this embodiment the dipole antenna is formed on the top layer and connected with the feed network on the top layer. In other words, the planar dipole antenna and the loop antenna are arranged on opposite sides of the substrate.

The antennas and antenna arrays as provided in the above embodiments have excellent electrical parameters such as wide operating bandwidth, low back radiation, and are stable in gain and radiation pattern shape over the frequency bandwidth. In particular, the wide operating bandwidth makes it highly attractive for the development of various kinds of indoor and outdoor base station antennas for modern cellular communication systems. The antenna has a simple structure and therefore can be made cheaply. The antenna can be used as a basic element in the design of low-cost high-performance antenna arrays with different gain and beam widths. The above embodiments have provided a planar complementary antenna that includes a planar dipole antenna and a loop antenna. Various feed networks, e.g., balun networks, differential input networks, etc., can be used to excite the antenna. The planar complementary wideband has low back radiation, stable gain, and a stable radiation pattern shape. The antenna embodiments disclosed have one or more of the following advantages: small size, wide bandwidth, good electric performance, low fabrication cost, and simple structure.

It will be appreciated by persons skilled in the art that numerous variations and/or modifications may be made to the invention as shown in the specific embodiments without departing from the spirit or scope of the invention as broadly described. Positional terms "top", "bottom", "above", "below", "horizontal", "vertical", and the like are used for illustration only; they are not intended to limit the orientation of the apparatus or device. The described embodiments of the invention should therefore be considered in all respects as illustrative, not restrictive.

For example, the planar dipole antenna can take a different form, preferably symmetric. The loop antenna can take a different form. The planar dipole antenna, the loop antenna, and the feed network can be formed with (but not limited to) conductive materials in the form of, e.g., strips, patches, etc., directly or indirectly connected with each other. The loop antenna need not include spaced-apart opposite ends. The loop antenna need not be a single-loop antenna. The loop antenna can be a loop antenna of different form, shape, and size, with a complete closed loop or the form of a near complete loop. The ground plane can be formed integrally with the loop antenna or the ground plane may be spaced apart from the loop antenna. The feed network can be a differential feed network instead of a balun network. The differential feed network can be arranged on the same side as the balun network. The differential feed network may include two input portions each arranged to receive a respective input signal (the two input signals being out of phase). The number, size, and position of vias can be varied, so long as they operably connect the planar dipole antenna, the loop antenna, and the feed network. The planar complementary antenna is particularly adapted for (but not limited to) operation at GHz and THz frequencies.

For example, the antenna array can be formed with different number of planar complementary antennas. The planar complementary antennas can be of different form, size, shape, and configuration. The antenna array is particularly adapted for (but not limited to) operation at GHz and THz frequencies.

The planar complementary antenna and related antenna array may be formed from a PCB substrate using, e.g., conventional PCB fabrication techniques.

The invention claimed is:

1. A planar complementary antenna, comprising:

a substrate with a first side and a second side opposite the first side;

a planar dipole antenna arranged on the first side of the substrate;

a loop antenna arranged on the first side of the substrate and operably connected with the planar dipole antenna;

a ground plane arranged on the first side of the substrate and directly connected with the loop antenna; and a feed network for connection with a feed source, the feed network being arranged at least partly on the second side of the substrate and being operably connected with the planar dipole antenna and the loop antenna for feeding an electrical signal from the feed source to the planar dipole antenna and the loop antenna so as to form an electric dipole at the planar dipole antenna and a magnetic dipole at the loop antenna;

wherein the loop antenna is disposed between the ground plane and the planar dipole antenna such that the ground plane is not directly connected with the planar dipole antenna.

2. The planar complementary antenna of claim 1, wherein the planar dipole antenna and the loop antenna are directly connected with each other.

3. The planar complementary antenna of claim 1, wherein the planar dipole antenna has a first antenna portion and a second antenna portion that are symmetric.

4. The planar complementary antenna of claim 3, wherein the first and second antenna portions each include:

a first conductive strip portion; and a second conductive strip portion generally extending at an angle to the first conductive strip portion.

5. The planar complementary antenna of claim 4, wherein the angle is about 90 degrees.

6. The planar complementary antenna of claim 1, wherein the feed network is arranged entirely on the second side of the substrate.

7. The planar complementary antenna of claim 6, further comprising one or more vias extending through the substrate, wherein the feed network is operably connected with the planar dipole antenna and the loop antenna through the one or more vias.

8. The planar complementary antenna of claim 1, wherein the feed network comprises a balun network.

9. The planar complementary antenna of claim 8, wherein the balun network comprises a first conductive strip and a second conductive strip.

10. The planar complementary antenna of claim 9, wherein the first conductive strip provides an input portion for connection with the feed source.

11. The planar complementary antenna of claim 10, wherein the second conductive strip provides a phase inverter.

12. The planar complementary antenna of claim 11, wherein the first conductive strip and the second conductive strip are arranged on the second side of the substrate.

13. The planar complementary antenna of claim 12, wherein the first conductive strip and the second conductive strip are spaced apart and extending substantially in parallel.

14. The planar complementary antenna of claim 10, wherein the first conductive strip is arranged on the second side of the substrate and the second conductive strip is arranged on the first side of the substrate.

15. The planar complementary antenna of claim 14, wherein the second conductive strip is connected directly across the loop antenna.

16. The planar complementary antenna of claim 1, wherein the feed network comprises a differential feed network.

17. The planar complementary antenna of claim 16, wherein the differential feed network is arranged entirely on the second side of the substrate.

18. The planar complementary antenna of claim 16, wherein the differential feed network comprises two input portions each arranged to receive a respective input signal, the two input signals being out of phase.

19. A communication device comprising the planar complementary antenna of claim 1.

20. The planar complementary antenna of claim 1, wherein the feed network is arranged to feed the electrical signal from the feed source to the planar dipole antenna and the loop antenna at or near an interface between the planar dipole antenna and the loop antenna.

21. An antenna array comprising:

a substrate with a first side and a second side opposite the first side;

a ground plane arranged on the first side of the substrate; and a plurality of antenna units each having:

a planar dipole antenna arranged on the first side of the substrate;

a loop antenna arranged on the first side of the substrate and operably connected with the planar dipole antenna and directly connected with the ground plane; and a feed network for connection with a feed source, the feed network being arranged at least partly on the second side of the substrate and being operably connected with the planar dipole antenna and the loop antenna for feeding an electrical signal from the feed source to the planar dipole antenna and the loop antenna so as to form an electric dipole at the planar dipole antenna and a magnetic dipole at the loop antenna;

wherein the loop antenna is disposed between the ground plane and the planar dipole antenna such that the ground plane is not directly connected with the planar dipole antenna.

22. A planar complementary antenna, comprising:

a substrate with a first side and a second side opposite the first side;

a planar dipole antenna arranged on the first side of the substrate;

a loop antenna arranged on the first side of the substrate and operably connected with the planar dipole antenna; and a feed network for connection with a feed source, the feed network being operably connected with the planar dipole antenna and the loop antenna for feeding an electrical signal from the feed source to the planar dipole antenna and the loop antenna so as to form an electric dipole at the planar dipole antenna and a magnetic dipole at the loop antenna;

wherein the feed network comprises a balun network that includes a first conductive strip arranged on the second side of the substrate and a second conductive strip arranged on the first side of the substrate;

wherein the first conductive strip provides an input portion for connection with the feed source; and wherein the second conductive strip is connected directly across the loop antenna.

* * * * *